US006295679B1

(12) United States Patent
Chenevert

(10) Patent No.: US 6,295,679 B1
(45) Date of Patent: Oct. 2, 2001

(54) METHOD OF MAKING FOOTWEAR

(75) Inventor: François Chenevert, Blainville (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/468,990

(22) Filed: Dec. 21, 1999

(30) Foreign Application Priority Data

Dec. 22, 1998 (CA) ..... 2256917

(51) Int. Cl.[7] ..... A43B 5/16

(52) U.S. Cl. ..... 12/142 P; 36/115; 280/11.12; 280/11.221

(58) Field of Search ..... 36/115; 12/142 P; 280/11.12, 11.221

(56) References Cited

U.S. PATENT DOCUMENTS

| | | |
|---|---|---|
| 1,243,993 | 10/1917 | Skoulikides . |
| 3,807,062 | 4/1974 | Spier . |
| 4,328,627 | 5/1982 | Sanders . |
| 4,385,456 | 5/1983 | Lovernois et al. . |
| 4,509,276 | 4/1985 | Bourque . |
| 4,655,465 | 4/1987 | Schaeffer . |
| 4,777,741 | 10/1988 | James . |
| 4,835,885 | 6/1989 | Hoshizaki et al. . |
| 5,339,544 | 8/1994 | Caberlotto . |
| 5,342,070 | 8/1994 | Miller et al. . |
| 5,380,020 | 1/1995 | Arney et al. . |
| 5,692,319 | 12/1997 | Parker et al. . |
| 6,018,892 * | 2/2000 | Acheson et al. . |

FOREIGN PATENT DOCUMENTS

| | | |
|---|---|---|
| 30 43 425 | 7/1982 | (DE) . |
| 9515094 * | 6/1995 | (WO) . |

* cited by examiner

*Primary Examiner*—Ted Kavanaugh
(74) *Attorney, Agent, or Firm*—Ratner & Prestia

(57) ABSTRACT

A method of making footwear. The method is suited generally to making skate boots and, more specifically, to making ice skates and in-line roller skates. The method comprises the steps of: (a) positioning a skin assembly over a structural inner shell component; (b) adhesively affixing the skin assembly to the structural inner shell component by applying pressure on the entire surface of the skin assembly; (c) perforating lace eyelets through the structural inner shell and the skin assembly; and (d) mounting a toe box and a tongue to the front portion of the structural inner shell component.

15 Claims, 12 Drawing Sheets

METHOD OF MAKING FOOTWEAR

FIELD OF THE INVENTION

The invention relates to a method of making footwear and more particularly for making a skate boot suitable for use on ice skates and for use on in-line roller skates. The invention also relates to a method of making boots and shoes.

BACKGROUND OF THE INVENTION

Traditionally, shoes, boots or skate boots are fabricated by shaping the footwear over a last. A last is a three-dimensional shape of the inside cavity of a boot or shoe, and which may be mounted upside down for ease of manipulation and assembly of the components making up the footwear. A pre-assembled fabric component is positioned over the last to be formed to the shape of the desire finished product. The pre-assembled component consists of various layers of fabric and/or leather material sewn and/or glued together, and sometimes reinforced with rigid components, which have the general configuration of the finished product but have not yet been shaped to the final form of the footwear. The rigidity and flexibility characteristics of the footwear are achieved by interposing the various layers of materials having suitable mechanical properties in specific regions of the pre-assembled component. An insole is positioned on the top portion of the last, which represents the inside bottom part of the footwear and the pre-assembled fabric component is positioned over the last. The fabric components are stretched over the last and pushed over the insole to conform to the specific shape of the last and then nailed or tacked, and glued to the insole to maintain the desired shape. Once the upper part of the footwear is completed, an outsole is glued over the preliminary assembly to finish the footwear. For skates, an accessory such as an ice runner holder or an in-line roller chassis is mounted to the outsole to complete the skate.

This type of process is extensively used in the shoemaking industry. It generates a good product but it has many disadvantages. For instance, the number of parts involved in the process can be staggering; a conventional ice skate for hockey may have some eighty parts to be assembled and shaped over the last. As a consequence, the manufacturing process is lengthy and complex. The nature of the assembly of part is inherently labor intensive and slow as there are many manual tasks to be performed and many steps are necessary to complete the footwear. The considerable number of elements to be assembled entails an increased risk of errors, particularly in the alignment of the various elements of the pre-assembled component. Also, the process of pushing and stretching the material over the last may not always provide a good alignment of the pre-assembled component over the insole. The accumulation of material between the insole and the outsole during the pulling and stretching step creates varations of the distance between the two parts, which are not desirable. The centering of the outsole with the formed pre-assembled component of the footwear become more difficult. The number of components involved in the process and the increased probability of misalignment of the various components, contribute at increasing the number of rejected shoes, boots or skates in the manufacturing process or at least, decrease the quality of the overall production. This traditional process of making footwear also requires several molds and cutting dies to produce all the parts necessary for making the footwear.

In an effort to reduce the number of components of footwear and specifically sports footwear like skiing and skating boot, these are increasingly made of a plastic molded shell and sometimes of a combination of a rigid with softer fabric components. U.S. Pat. No. 4,777,741 to Laurence discloses an article of footwear such as a shoe or skate, which comprises a molded exterior lower shell and a semi-rigid molded tongue portion to dose the footwear. U.S. Pat. No. 4,509,276 to Bourque discloses a skate boot made of a lower exterior molded rigid plastic portion and intermediate and upper portions made of pliable material to allow forward flexure and torsional flexibility in the ankle area. Finally U.S. Pat. No. 5,339,544 to Alberto discloses a footwear comprising a first component made of a single piece of molded synthetic material having a rear upper portion which extend from an insole, and a second component made of soft material having a front upper portion and a lining. The two components are connected together with the lining of the second component inserted inside the rear portion of the first component.

These designs effectively reduce the number of components utilized in the manufacturing process of a footwear or skate. However, the final product issued from any of these methods of making footwear, whether a shoe, a boot, or a skate, has the appearance of a plastic shell. Consumers are not particularly fond of the plastic shell look for footwear and show a preference to fabric or leather footwear product.

Thus there is a need in the industry for a method of making a footwear which controls the end shape and volume of the footwear and also utilizes fewer components and fewer steps than the traditional lasting method yet provides a final product that has the appearance of a footwear made with the traditional lasting method.

OBJECTS AND STATEMENT OF THE INVENTION

It is thus an object of the invention to provide a method of making footwear that uses fewer components and fewer steps than the traditional lasting method.

It is another object of the invention to provide a method of making footwear that has the appearance of footwear made with the traditional lasting method.

It is another object of the invention to provide a method of making footwear that is cost effective.

It is another object of the invention to provide a method of making footwear that provides consistency of assembly between parts and reduces rejects in the manufacturing process.

It is a further object of the invention to provide a method of making footwear which enable automation of the manufacturing process.

As embodied and broadly described herein, the invention provides a method of making a footwear comprising the steps of:

(a) positioning a skin assembly over an inner shell component;

(b) adhesively affixing said skin assembly to said inner shell component by applying pressure on the entire surface of said skin assembly;

(c) perforating lace eyelets through said inner shell and said skin assembly; and, (d) mounting a toe box and a tongue to the front portion of said inner shell component.

Advantageously, the method further comprises the steps of mounting a ground-engaging supporting element to the bottom portion of the inner shell component and inserting a footbed into the footwear for cushioning the bottom portion of the footwear, the same method applies for making an ice skate and an in-line roller skate.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
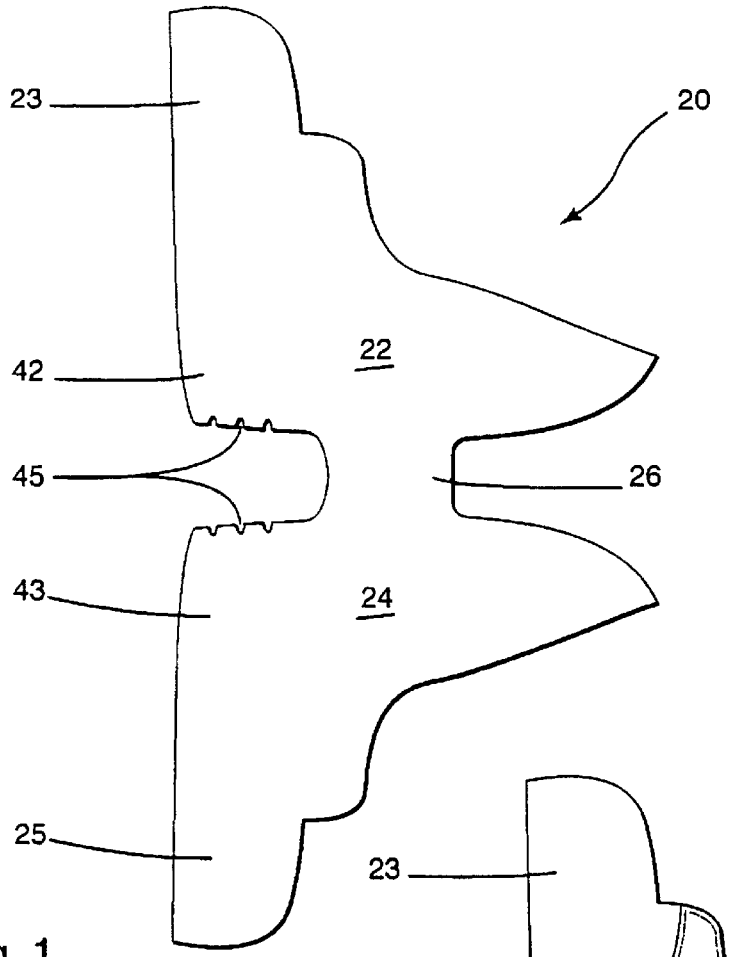
FIG. 1 is a top plan view of a skin for a footwear constructed according to the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

FIG. 1 illustrates a skin 20, which has been cut from a flat piece of fabric material or leather material. The cutting operation of skin 20 may be fully automated since it is performed on a flat surface. Skin 20 comprises a right quarter 22 and a left quarter 24 linked together by a bridge portion 26. Each quarter 22 and 24 further comprises half-tendon guards 23 and 25 respectively. The heel portions 42 and 43 of each quarter 22 and 24 is given a slightly curvilinear profile to enable the formation of a rounded heel counter later on in the fabrication process of the footwear. Heel portions 42 and 43 are also provided with indentations 45 to ease the formation of a rounded heel counter.

Figure 2:
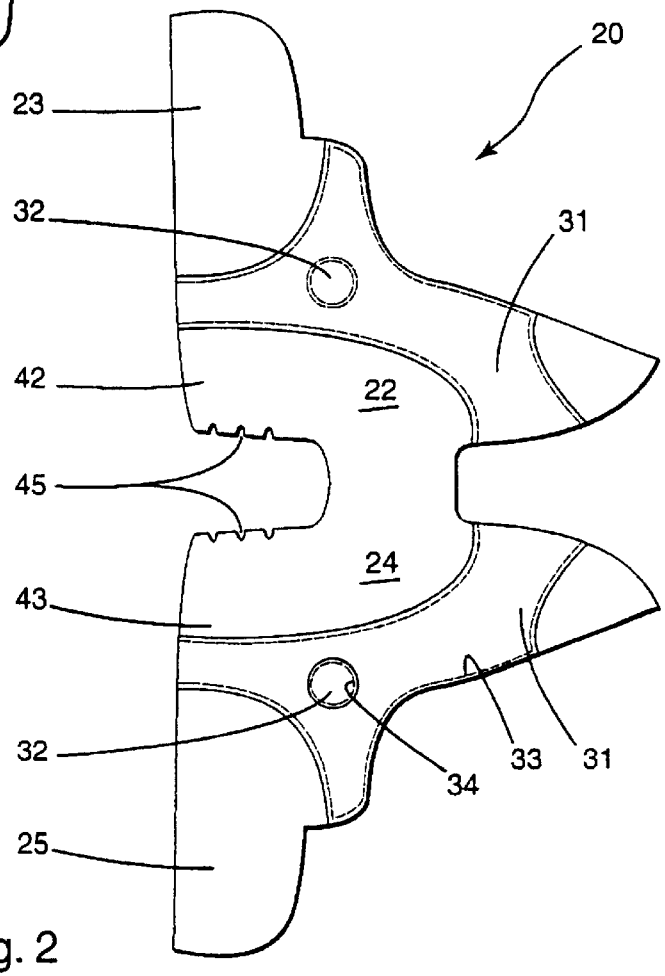
FIG. 2 is a top plan view of the skin shown in FIG. 1 with some decorative components added.

FIG. 2 illustrates a skin 20 to which decorative components 31 and 32 were added. Decorative components 31 and 32 are assembled to skin 20 by automated process such as automatic stitching or welding. The automation of this process is again simplified because it is done on a flat surface. Components 32 may be stitched, welded or glued to components 31 in a first step then the assembly of components 31 and 32 may be assemble to skin 20 in a final step. Of course, the assembly of the various decorative components may be performed in any order to adapt to the specific physical requirements of available manufacturing equipment. It can also be done all at once. The flexibility of fabrication of the skin assembly is due primarily to the fact that all the operations, including the cutting of skin 20, are performed while the fabric material is laying down flat. FIG. 2 illustrates the decorative components 31 and 32 stitched to skin 20 as shown by the stitching lines 33 and 34 by way of example only. Decorative components 31 and 32 could be welded or glued or otherwise affixed to skin 20 in any known fashion without departing from the principle of assembling as many if not all skin components while the various pieces are flat and therefore easy to work. The process is thereby simplified and can readily be automated.

Figure 3:
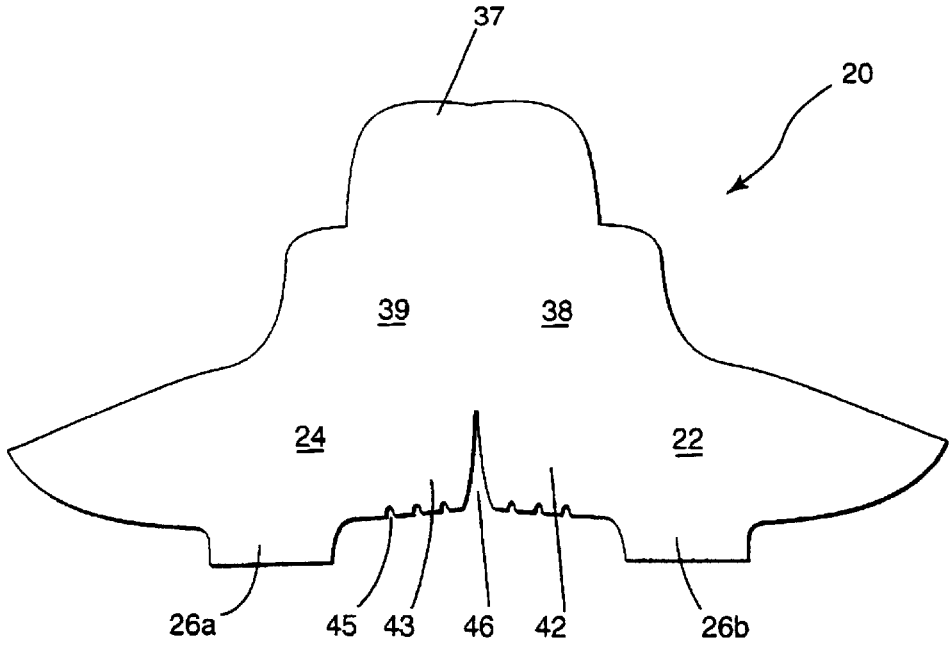
FIG. 3 is a top plan view of a second embodiment of a skin for the footwear constructed according to the invention.
Figure 4:
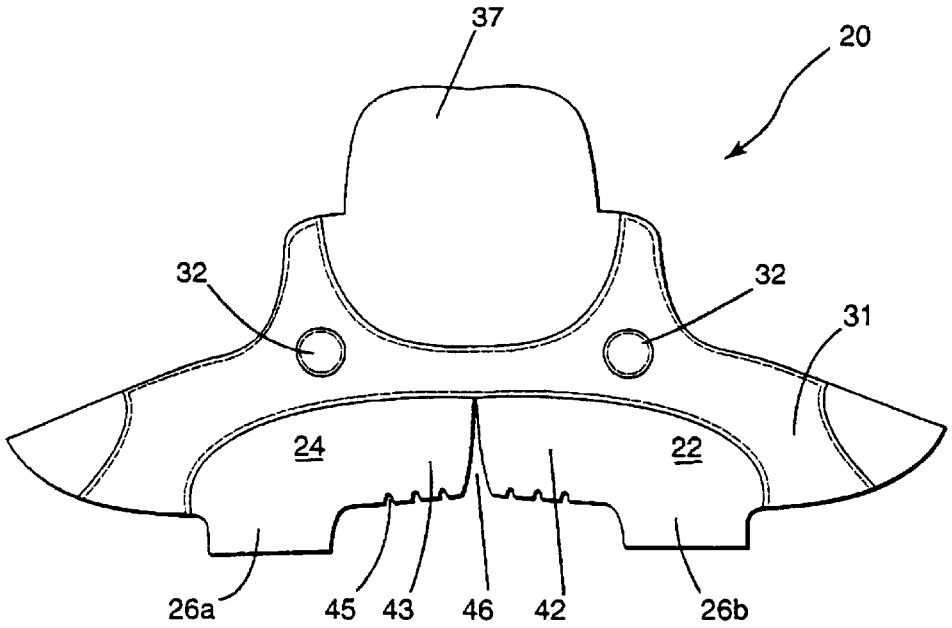
FIG. 4 is a top plan view of the skin shown in FIG. 3 with some decorative components added.

FIGS. 3 and 4 illustrate a variation of a skin 20. The right quarter 22 and the left quarter 24 are, in this case, linked together at tendon guard 37, which is the equivalent of the assembly of half-tendon guard 23 and 25, and at the rear portions 38 and 39 of each quarter 22 and 24. Half-bridge portions 26A and 26B are provided at the lower part of each quarter 22 and 24, to be used later on to form the skin assembly of the footwear. In this variation the heel portions 42 and 43 are separated by a cut-out portion 46 which has curvilinear walls to enable the formation of a rounded heel counter as previously mentioned when referring to slightly curvilinear profile of heel portions 42 and 43 shown in FIGS. 1 and 2. Heel portions 42 and 43 are also provided with indentations 45 to facilitate the formation of a rounded heel counter.

FIGS. 3 and 4 illustrate each quarter 22 and 24 having a similar profile to quarters 22 and 24 of skin 20 shown in FIG. 1 and 2. FIG. 3 illustrates a skin 20 made from a single flat piece of fabric or leather material whereas FIG. 4 illustrates a skin 20 with decorative components 31 and 32 added in the same fashion as previously described in FIG. 2.

Skin 20 is cut, as its profile indicates, to conform to the general shape of a boot. Skin 20 may have a variety of shapes and profiles to conform to different types of footwear. For example, a low-cut boot would not feature a tendon guard 37 and its skin would be designed without one. Similarly, a shoe type footwear as shown in FIGS. 11 to 15 features a skin 20 which is very low and barely reaches the foot's malleollis. Shown in dotted lines is a variation of a footwear having higher sides which cover the foot's malleollis.

The skin 20 shown in FIG. 2 will be used as an example to illustrated the process of making a footwear according to the invention. Other types of skin configuration and pattern, such as those shown in FIGS. 1, 3 and 4 could be used. As a further variation of skin 20, quarters 22 and 24 may be two single pieces joined together by a third piece covering bridge portion 26.

Figure 5:
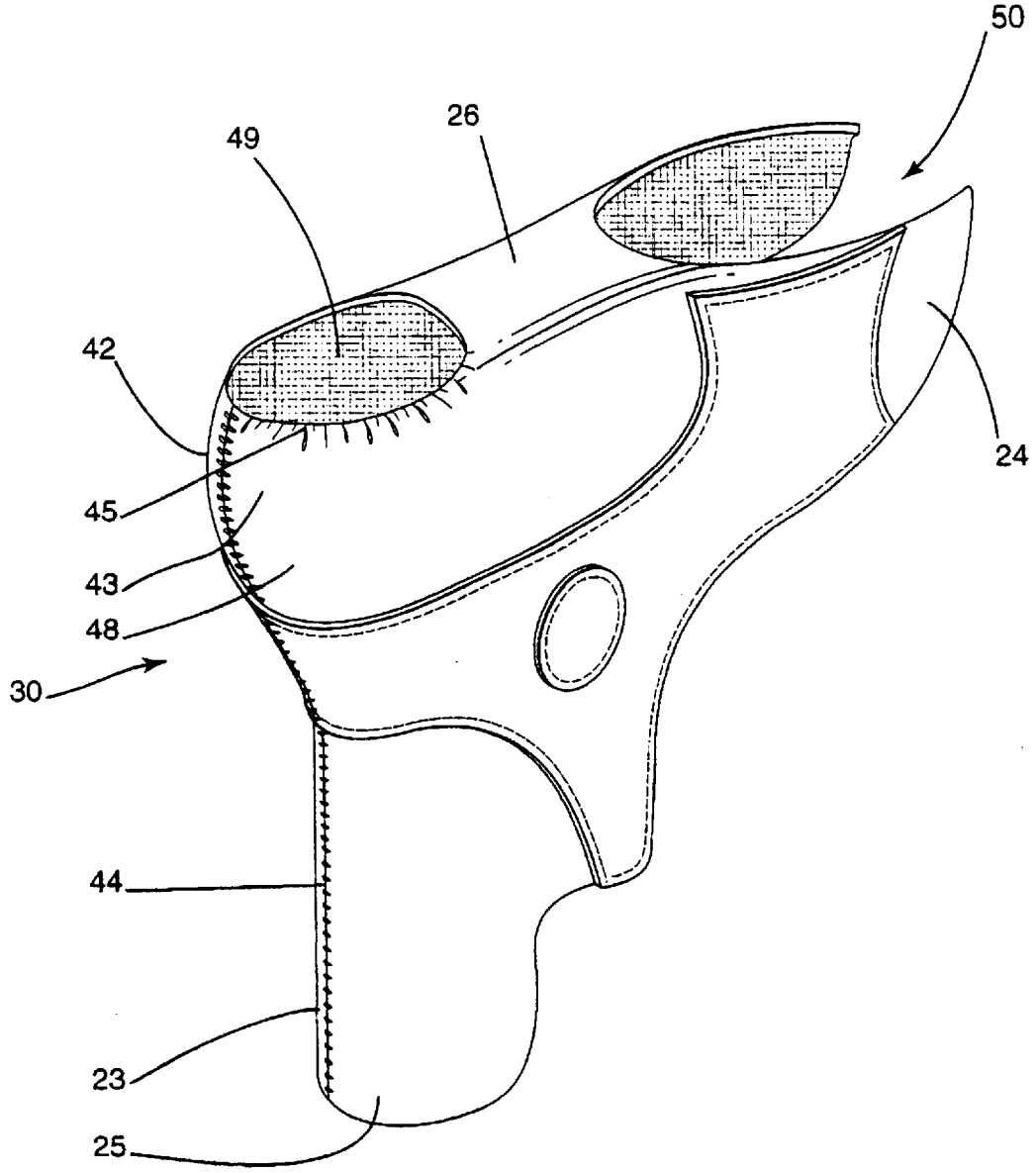
FIG. 5 is a perspective view of a skin assembly for the footwear constructed according to the invention.

Referring now to FIG. 5, the flat skin 20 has been folded at the bridge portion 26 and sewn at the rear edges of cuff portions 23 and 25 and at heel portions 42 and 43 to form a skin assembly 30. The resulting seem 44 may be covered by an additional decorative piece if desired (not shown). As previously mentioned, when both heel portions 42 and 43 are sewn together, they form a rounded heel counter 48 which better conforms to the contours of the foot. Indentations 45 are also folded to form a round edge at the bottom portion of heel counter 48.

The skin assembly 30, once formed, preferably has openings 49 and 50 in its bottom portion, which provide direct access to the internal structure of the footwear.

Figure 6:
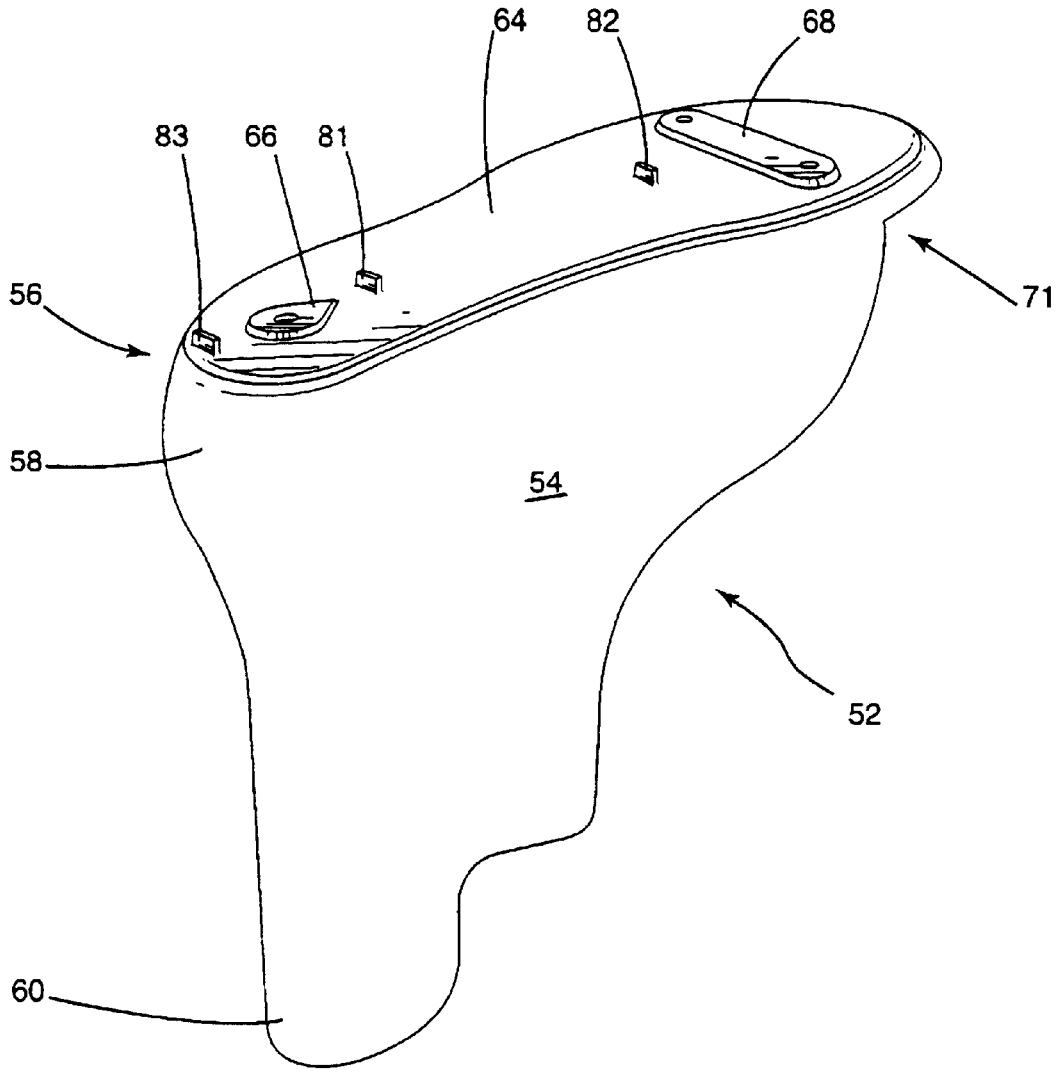
FIG. 6 is a perspective view of a molded inner shell component of the footwear constructed according to the invention.

FIG. 6 illustrates a molded inner shell 52 having the general outer shape of a boot. Inner shell 52 is preferably made of injected thermoplastic. It comprises a heel counter 58 and a tendon guard 60, a medial quarter 54 and a lateral quarter 56 of variable thickness extending longitudinally from heel counter 58 to the front of inner shell 52. Quarters 54 and 56 each have an edge 63, which together define the main opening for insertion and removal of the foot. A sole 64 extends the entire length of inner shell 52. Inner shell 52 is the central component of the footwear to be constructed. It is molded to conform generally to the shape of the foot and the shape given to inner shell 52 thereby dictates the general shape of the footwear. Inner shell 52 further provides the supporting structural element of the footwear. Since inner shell 52 is made and manufactured by injection molding, variation of its wall thickness is easily achieved. By strategically varying its wall's thickness, inner shell 52 may be provided with areas, which are more or less rigid and more or less flexible, as desired, depending on the purpose of the final product. For instance, an ice skate molded inner shell would have to have more overall rigidity than shoes for football or plain running shoes.

Variations of the materials employed or combining two or more materials are other methods of changing and varying the physical properties of inner shell 52 and therefore of the final footwear so constructed. Compatible materials may be manufactured by successive injections into the same mold. For example, an inner shell 52 may be molded with two materials: a more rigid material in areas where more support is necessary combined with a softer material in areas requiring more flexibility. Also, in the area corresponding generally to edges 63 where the lace eyelets will eventually be positioned, a slightly more resilient material may be used or the thickness of the material can be marginally increased in an effort to reinforce this locally solicited area.

Sole 64 may be substantially flat or it may comprise, as shown in FIG. 6, bottom projections 66 and 68 as means for attachment- to a ground engaging supporting element such as an ice runner or an in-line roller chassis. Projection 66 and 68 are designed to mate the opposing surface of the ground-engaging supporting element. This arrangement is shown as an example only since there are many possible variations. Sole 64 also comprises positioning pins 81, 82 and 83 adapted to align skin assembly 30 with inner shell 52.

Figure 10:
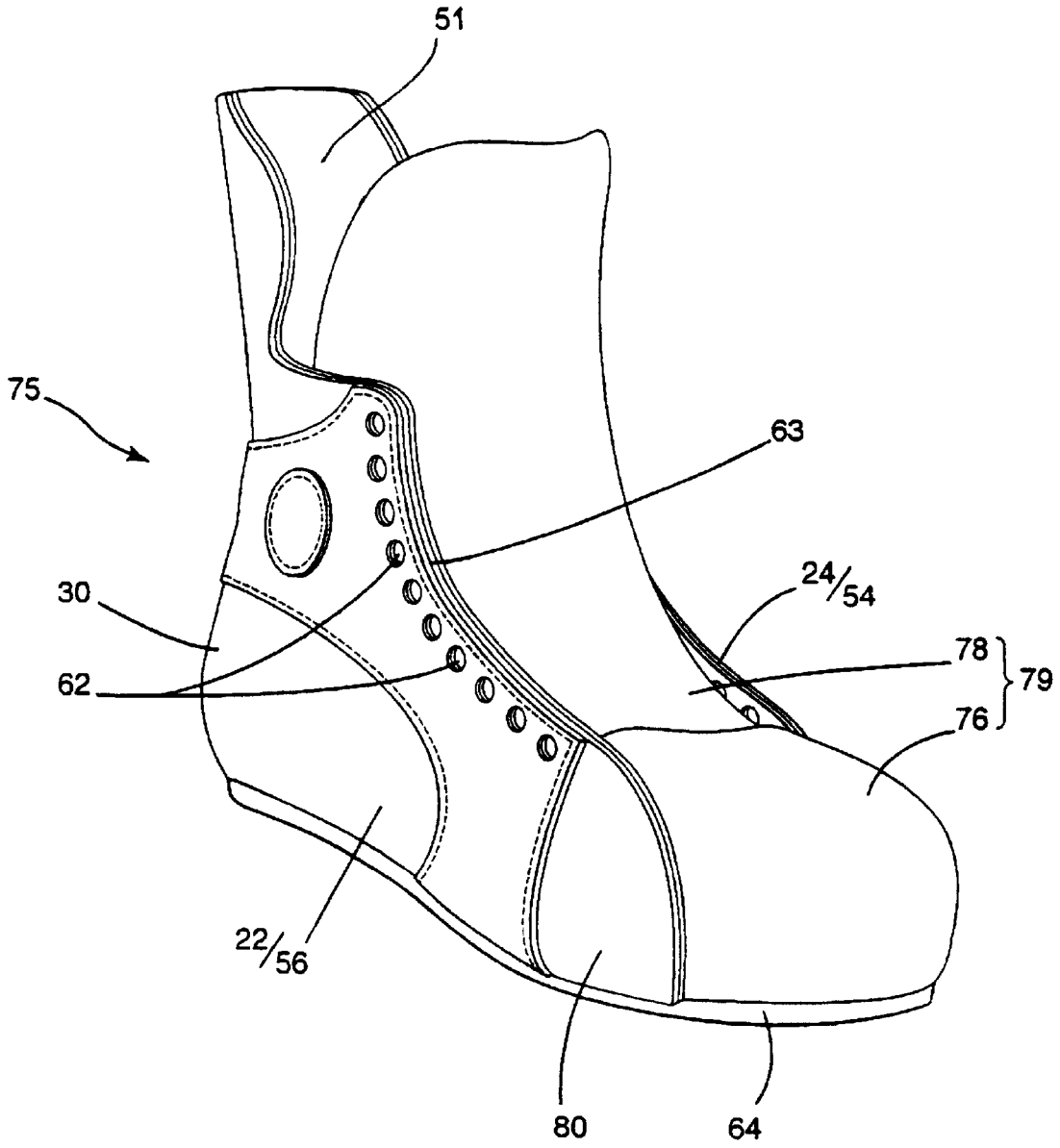
FIG. 10 is a perspective view of a completed boot constructed according to the invention.

Please note that the frontal portion of inner shell 52 in the toe area 71 is open. Although not necessary, it allows the installation of a toebox/tongue assembly as shown in FIG. 10. As a variation, Inner shell 52 could easily be closed at the toe area 71 so that the toe box would be integral with inner shell 52.

Figure 7:
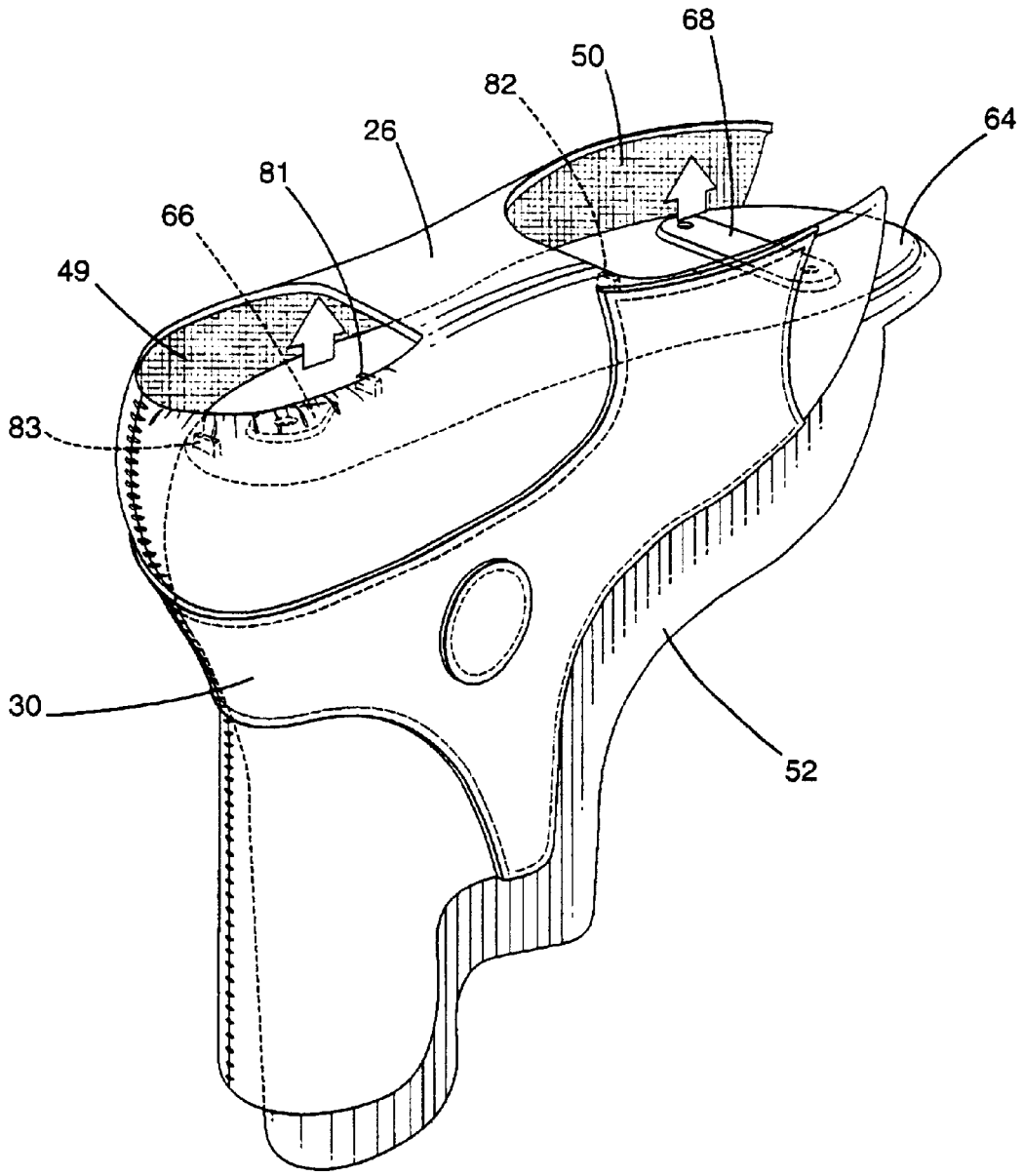
FIG. 7 is a perspective view illustrating the assembly of the skin assembly and the molded inner shell component of the footwear constructed according to the invention.
Figure 8:
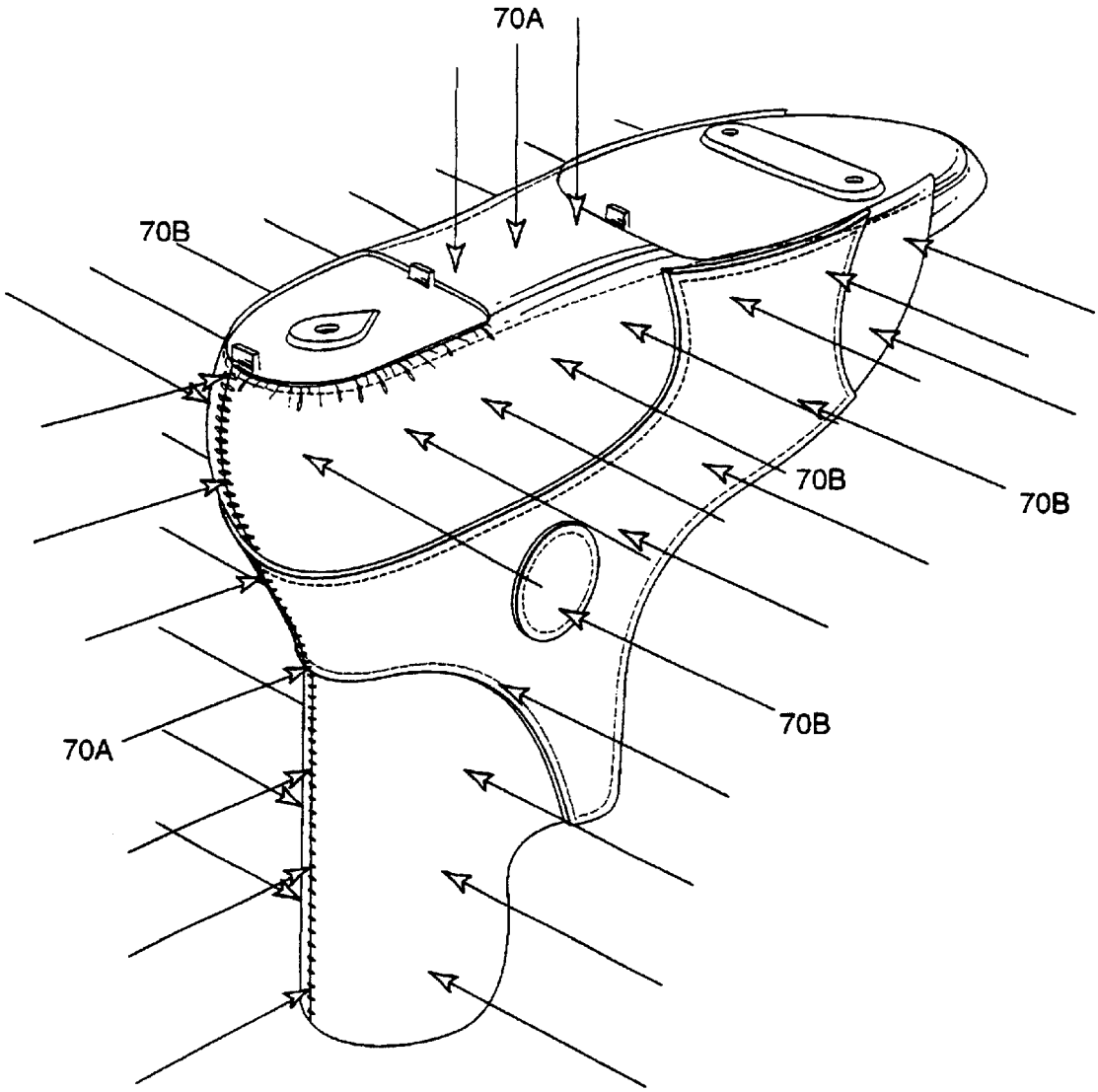
FIG. 8 is a perspective view illustrating the application of pressure to the surface of the skin assembly and the molded inner shell component according to the invention.

The configuration of inner shell 52 and its inherent rigidity eliminates the need to use a last to shape the skin assembly 30. As shown in FIGS. 7 and 8, skin assembly 30 is positioned over inner shell 52. The general shape of skin assembly 30 ensures a good alignment between the two components. The alignment of openings 49 and 50 of skin assembly 30 with positioning pins 81, 82 and 83 provides increased accuracy of alignment. As best shown in FIG. 8, positioning pins 81, 82 and 83 correspond to the outer edges of openings 49 and 50 thereby ensuring proper alignment of the two components. Other means of alignment are possible without the use of opening 49 and 50. Other Positioning pins (not shown) could be added to inner shell 52, which could be inserted into corresponding apertures of skin assembly 30 to align the two components 30 and 52.

Prior to positioning the skin assembly 30 over inner shell 52, glue must be applied either to the interior surface of skin assembly 30 or the exterior surface of inner shell 52. Once skin assembly 30 is in place, pressure is applied to the entire surface of skin assembly 30 as depicted by arrows 70A and 70B thereby solidly gluing the two components together. The skin assembly 30 will conform exactly to the, shape of inner shell 52 without the use of a form or last. The only rigid shape required for the process is the inner shell 52 itself.

Figure 9:
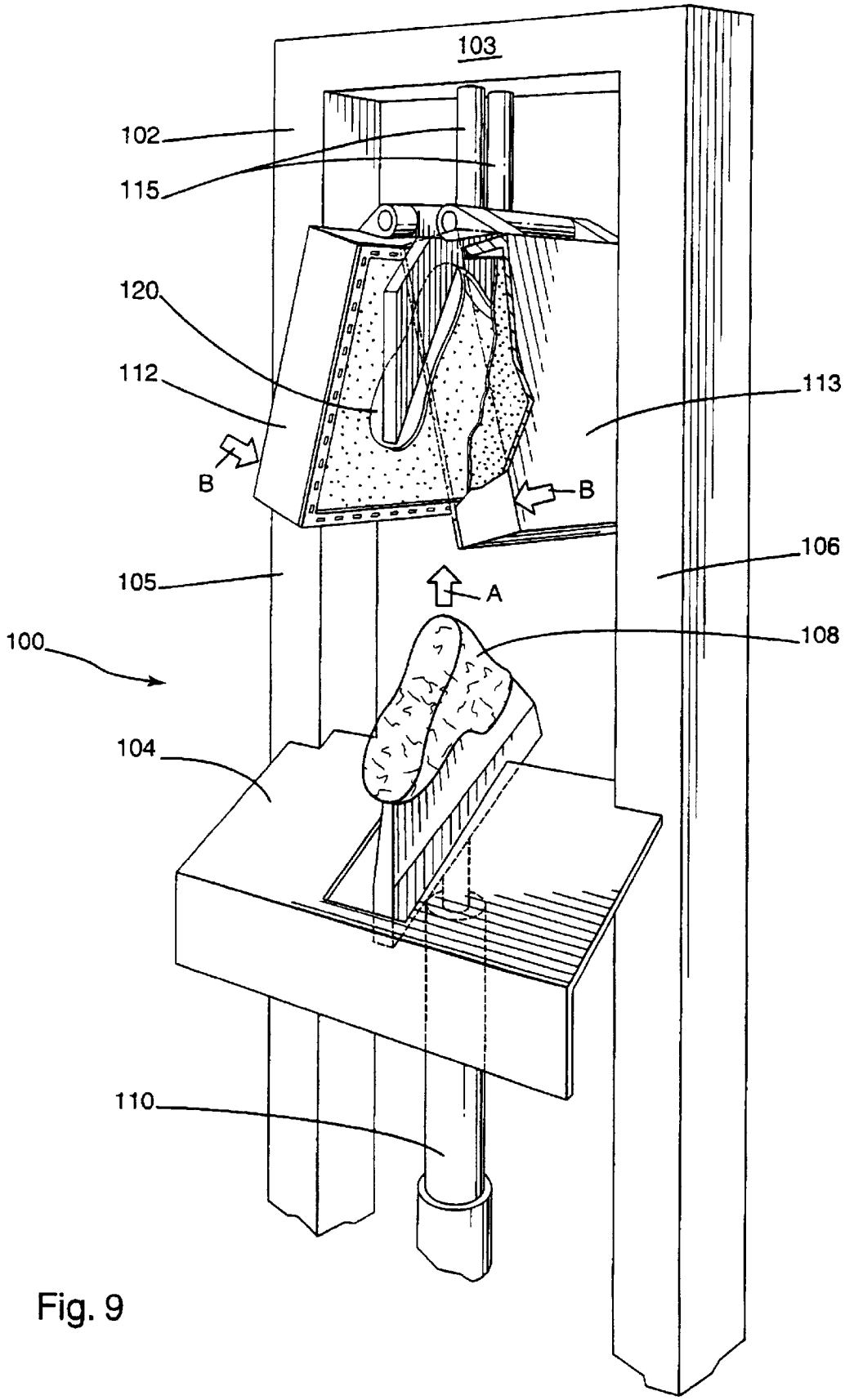
FIG. 9 is a perspective view of an apparatus used to apply pressure to a skin assembly as depicted in FIG. 8 according to the invention.

FIG. 9 illustrates an example of an apparatus 100, which may be used to evenly apply pressure to the entire surface of skin assembly 30. Other means of applying even pressure to skin assembly 30 are possible without departing from the basic method hereby described. The clamping apparatus 100 shown in FIG. 9, comprises a supporting frame 102 having an upper traverse 103, and two pillars 105 and 106 joined together at mid-height by an apron 104. Control buttons are usually positioned on apron 104 for ease of access. Apron 104 surrounds a movable shell-supporting member 108 is having the general shape of an inner shell 52 and is mounted to a generally vertical hydraulic or pneumatic piston-cylinder 110. A pair of clamps 112 and 113 are mounted to traverse 103 with struts 115 and are positioned directly above shell-supporting member 108. Clamps 112 and 113, each are provided with a bladder 117 consisting of an inflated flexible membrane and a fluid pressure delivery circuit (not shown). A pressure pad 120 having a general shape which substantially mates with the sole portion and the rear portion of inner shell 52 is located in between clamps 112, 113 at the top portion of the clamping pair.

In operation, the assembly of inner shell 52 and skin assembly 30 are positioned on shell-supporting member 108 and the operator activates the apparatus 100. The cycle of apparatus 100 begins with the activation and extension of piston-cylinder 110, which raises shell-supporting member 108 and therefore, inner shell 52 and skin assembly 30 upwardly, as shown with 30 arrow "A", in between the open pair of damps 112, 113. Shell-supporting member 108 travels up and reaches pressure pad 120, at which point pressure builds up into piston-cylinder 110 to a set value and stops. The mating surface of pressure pad 120 and Shell-supporting member 108 thereby apply the initial pressure 70A to the sole portion and the rear portion of skin assembly 30 onto inner shell 52. Clamps 112 and 113 are then closed onto inner shell 52 and skin assembly 30 as shown with arrows "B". With clamps 112, 113 closed and locked over the assembly, bladders 117 are inflated by air or liquid injection, which forces the flexible membranes of bladders 117 to encircle each quarter 22 and 24 of skin assembly 30 and apply pressure 70B of FIG. 8. Pressure builds up inside inflated bladders 117 to a set value and the flexible membranes apply an even pressure 70B to each quarter surface of skin assembly 30. The pressure is maintained for a few seconds and then released. Clamps 112 and 113 open up and shell-supporting member 108 is lowered to its initial position by piston-cylinder 110 retracting. The two initial components 30 and 52 are properly glued and can be removed from shell-supporting member 108.

To provide good adhesion between skin assembly 30 and inner shell 52 using damping apparatus 100, a pressure build-up of about 30PSI is contemplated. Such a pressure requires that inner shell 52 be properly supported by shell-supporting member 108 during the application of the pressure. To that effect, shell-supporting members 108 of different sizes are provided for each footwear sizes being produced. This ensures that inner shell 52 will not collapse or distort during the application of a pressure of this magnitude. However, a much lower pressure can be used which will provide adequate adhesion. The pressure required for providing good adhesion between skin assembly 30 and inner shell 52, is a function of the rigidity of skin assembly 30's material, the complexity of the shape of the footwear. To improve and accelerate the gluing process, shell-supporting member 108 may be provided with heating and cooling channels (not shown). Depending on the type of glue being used, the part may be heated and then cooled to increase the efficiency of the process.

The manufacturing process is no longer a series of consecutive assembly steps which occur over the last of the footwear but is simply a joining together of two prefabricated items manufactured separately using different methods. This manufacturing process increases the possibilities of automation, as each item is fabricated separately and brought together at the end of the production cycle. Furthermore, the fabrication of skin assembly 30 from a flat skin 20 reduces the possibilities of errors and likewise, the injection molding of inner shell 52 is not conducive to errors. Once the mold is optimal, each part being produced from the mold is unlikely to substantially vary. The joining of the two components as previously explained only requires a minimal control of the alignment of the two prefabricated parts. This modular approach of the manufacturing process leads to a decrease in rejected items during production, a better control of the end shape and volume of the footwear and of course to a decrease in overall cost as production is rationalized.

As shown in FIG. 10 the remaining steps in the fabrication of the footwear 75, are first, to punch lace eyelet holes 62 along the edges 63 using a automatic punch which guides itself along edges 63 and rapidly punches a series of eyelets 62 equally spaced apart. The following step is to install a toe box 76 and a tongue 78 or preferably, in the spirit of a modular approach, a toe-box/tongue assembly 79, which covers the frontal portion of the footwear 75. Toe-box/tongue assembly 79 is also manufactured separately and brought to the production line at the end of the production cycle only. Tongue 78 is sewn or glued to toe-box 76. Toe-box 76 is glued to the upper frontal portion of sole 64 and can also be glued or sewn to the frontal portions 80 of each quarter 22/56 and 24/54. A ground engaging supporting element such as an ice runner holder, an in-line roller chassis or any type of sole suitable for football, baseball, soccer or golf shoes is installed on the bottom of footwear 75.

A suitable liner 51 is finally installed within the inner shell 52 of footwear 75. The liner is preferably made of preformed foam material extending along each quarter 54 and 56 and around the heel counter region. A footbed (not shown) adapted to the contours of the foot is also positioned at the bottom of inner shell 52 to provide the required level of comfort to the footwear 75.

Figure 11:
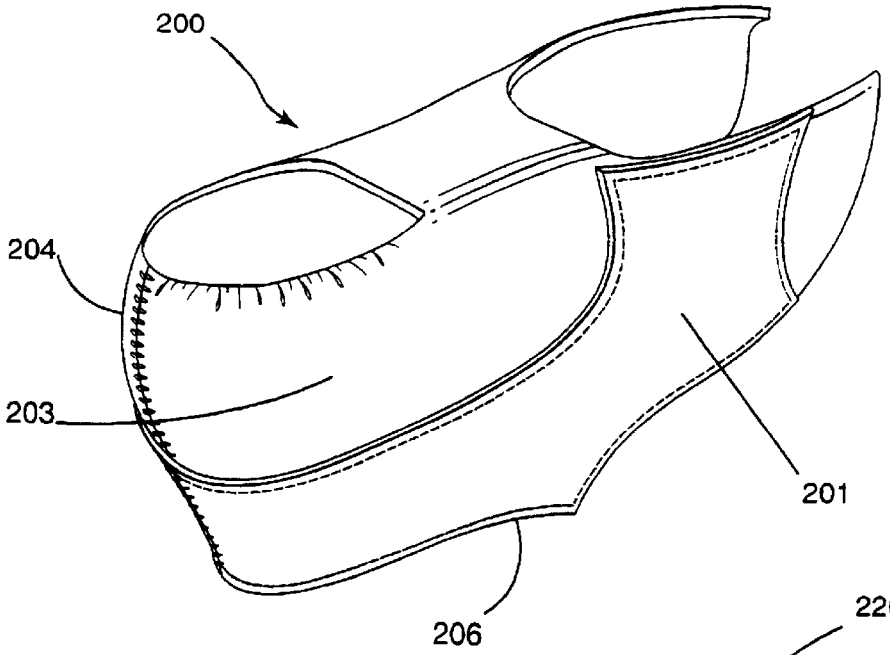
FIG. 11 is a perspective view of a second embodiment of a skin assembly for the footwear constructed according to the invention.

FIGS. 11 to 15 illustrate the various components and steps necessary to fabricate a low-cut footwear according to the same basic method. FIG. 11 shows a skin assembly 200, which has been folded, from a previously flat skin and sewn at the rear edges of each quarter 203 and 204. A decorative component 201 was assembled to the flat skin by automated process as previously described. Skin assembly 200 presents a low cut profile. The upper edges 206 are much lower than skin assembly 30 shown in FIG. 5 as it extends nearly below the malleolis of the foot.

Figure 12:
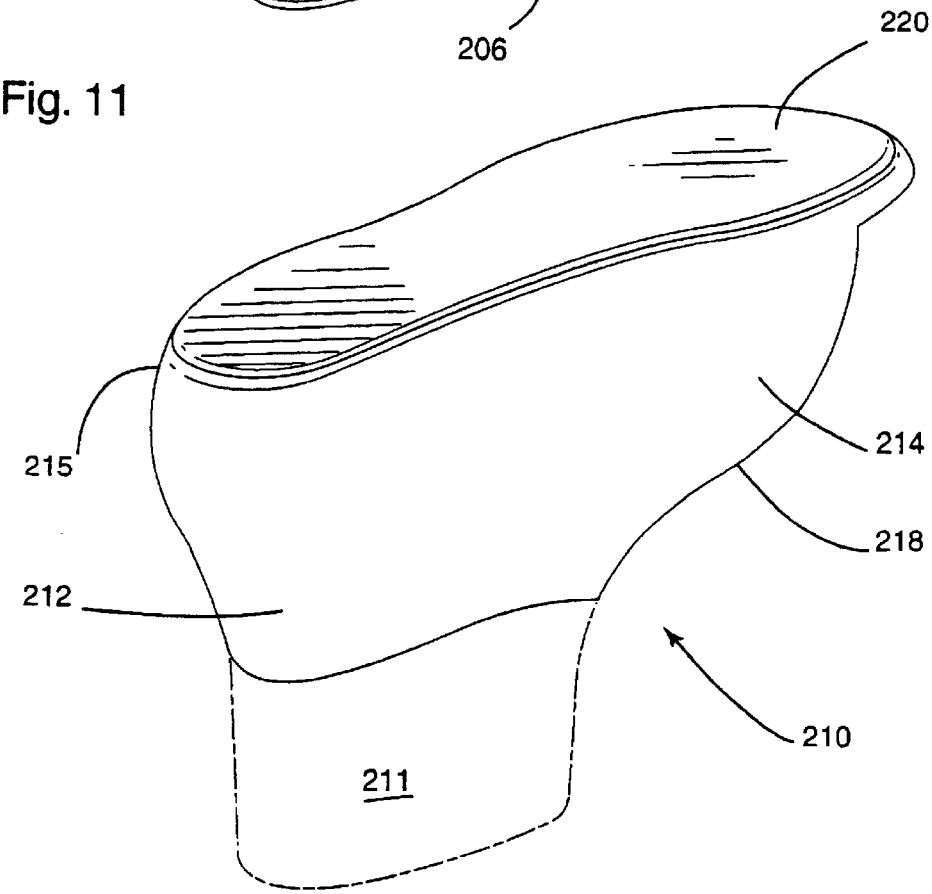
FIG. 12 is a perspective view of a second embodiment of a molded inner shell component of a footwear constructed according to the invention.

FIG. 12 shows a molded inner shell 210 preferably made of injected thermoplastic, which also presents a low-cut profile having the general outer shape of a shoe. Inner shell 210 comprises a heel counter 212, a medial quarter 214 and a lateral quarter 215 of variable thickness extending longitudinally from heel counter 212 to the front portion of inner shell 210. Edges 218 define the main opening for insertion and removal of the foot, and a sole 220 extends the entire length of inner shell 210. Inner shell 210 is the central component of the shoe to be constructed. It is molded to generally conform to the shape of the foot and its shape dictates the general shape of the footwear. Inner shell 210 further provides the supporting structural element of the footwear. As previously described, variations of inner shell 210's wall thickness, variations of materials, or combination of two or more materials are methods of changing and adapting the physical properties of inner shell 210 and of the footwear so constructed for its intended use.

It must be understood that the general outline of inner shell 210 may take on a variety of shapes such as that of a boot as depicted by the dotted lines 211. Skin assembly 200 may or may not conform to the boot outline 211. As a variant, skin assembly may cover only partially inner shell 210 leaving portions of inner shell 210 exposed, giving the footwear a different look. Boot outline 211 may be a hiking boot or a work boot. In the later instance, a steel toe cap would be provided.

Sole 220 is substantially flat and adapted to accommodate a variety of outsoles. The Outsole of the footwear may feature spikes for football, baseball or soccer shoes or studs for golf or track and field shoes. Sole 220 may feature apertures provided to insert metal or plastic studs or spikes.

Figure 13:
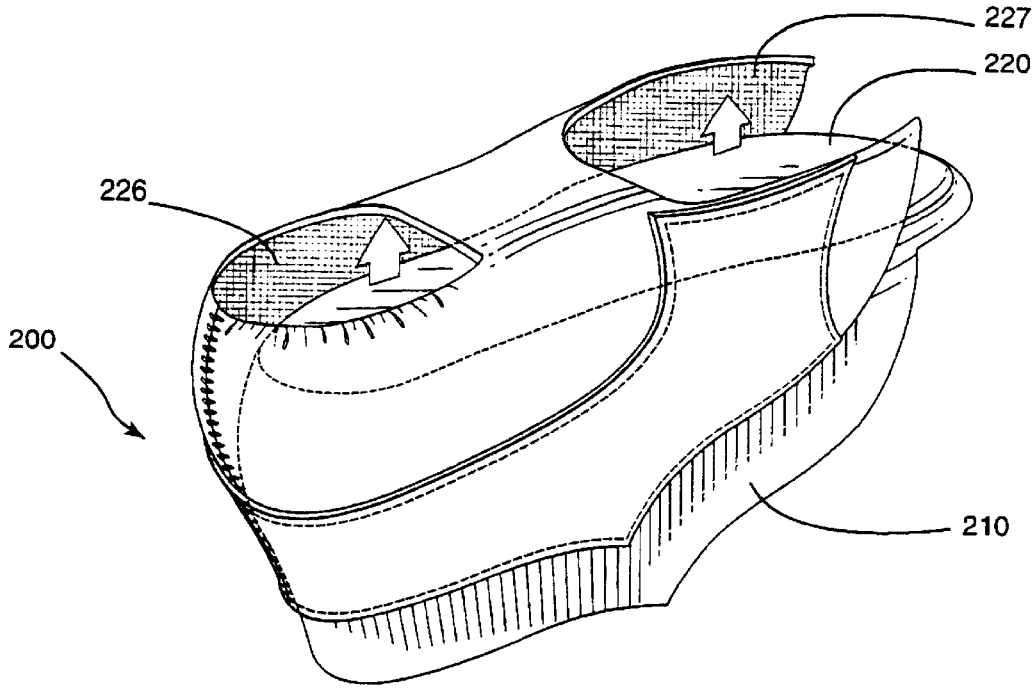
FIG. 13 is a perspective view of the assembly of the skin assembly and the molded inner shell component shown in FIGS. 11 and 12.
Figure 14:
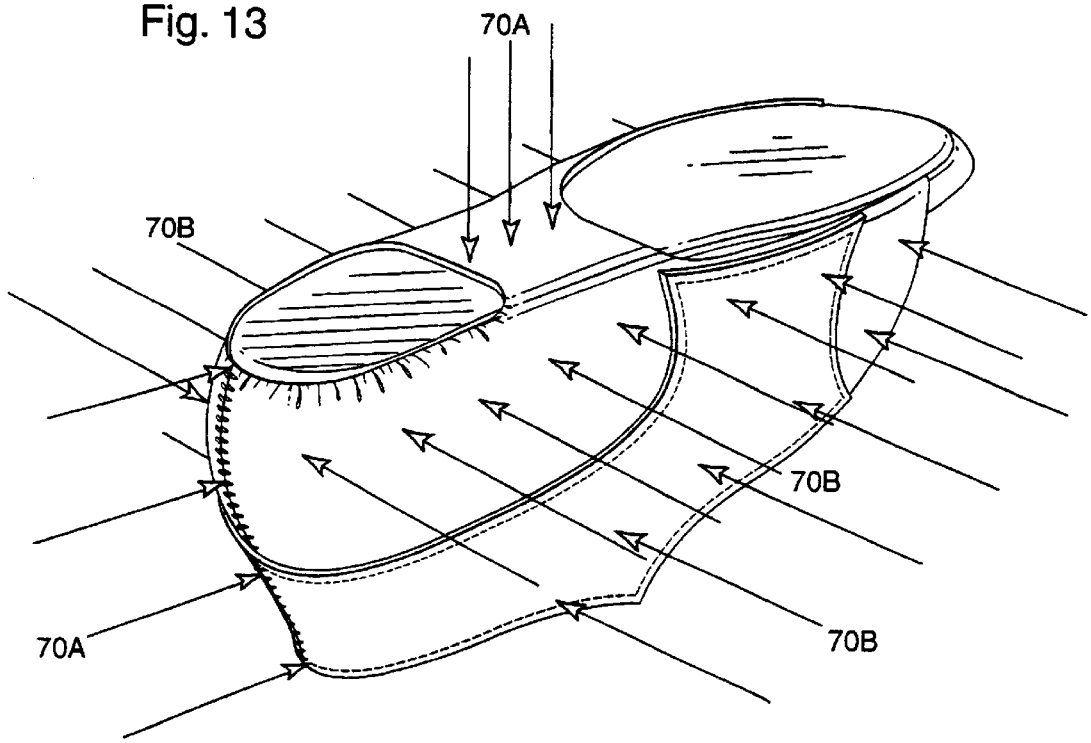
FIG. 14 is a perspective view of the application of pressure to the surface of the skin assembly and the molded inner shell component shown in FIGS. 11 and 12 of a footwear constructed according to the invention.

As shown in FIGS. 13 and 14, skin assembly 200 is positioned over inner shell 210 after a layer of glue has been applied to either the inner surface of skin assembly 200 or to the outer surface of inner shell 210 or both. The general shape of skin assembly 200 ensures a good alignment between the two components. The alignment accuracy may increase with positioning pins as shown in FIG. 6. Other means of alignment are also possible as previously mentioned. Once skin assembly 200 is in place, pressure is applied to the entire surface of skin assembly 200 as depicted by arrows 70A and 70B thereby solidly gluing the two components together. A clamping apparatus 100 as shown in FIG. 9 can be used to provide the necessary pressure. The shell-supporting member 108 and the pressure pad 120 simply have to be modified to accommodate the specific shape of inner shell 210.

Figure 15:
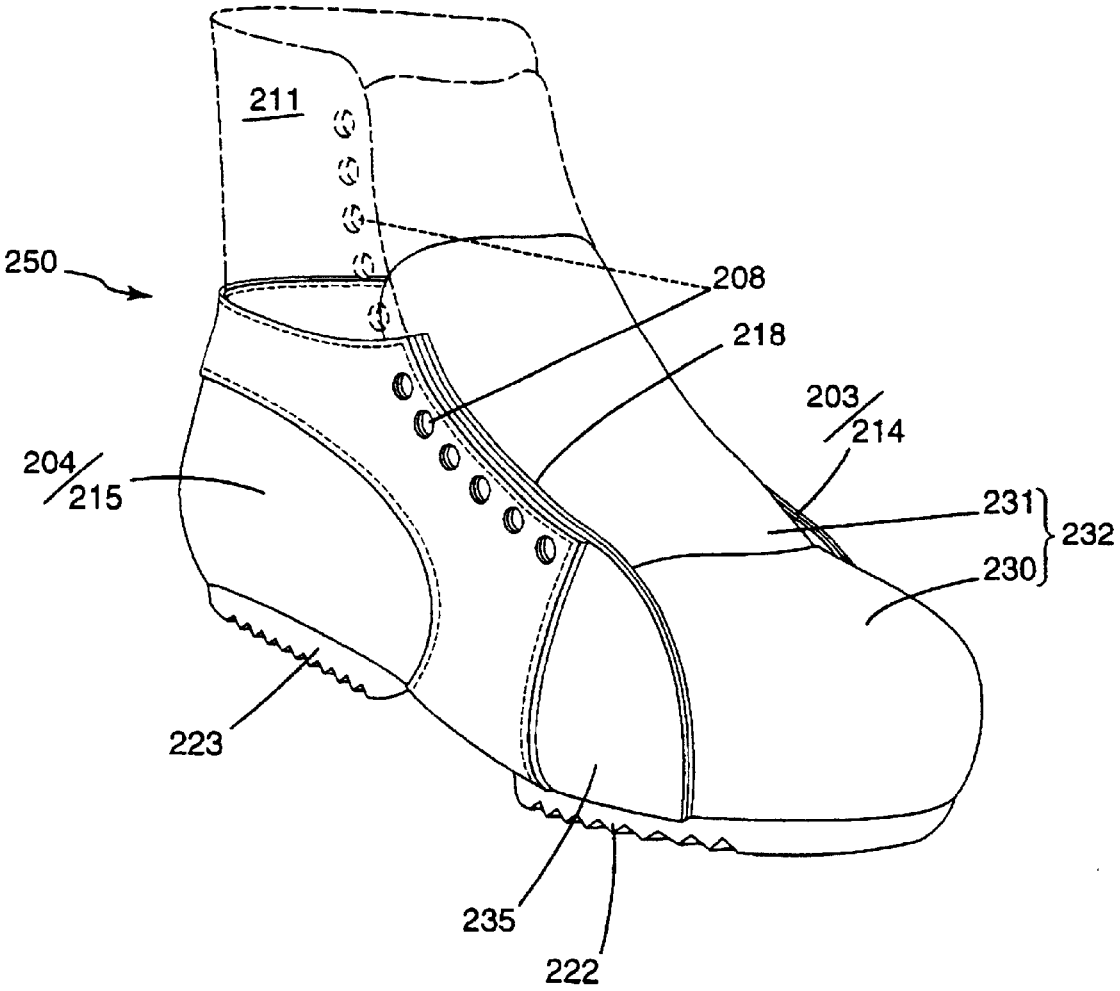
FIG. 15 is a perspective view of a second embodiment of a footwear constructed according to of the invention.
Figure 16:
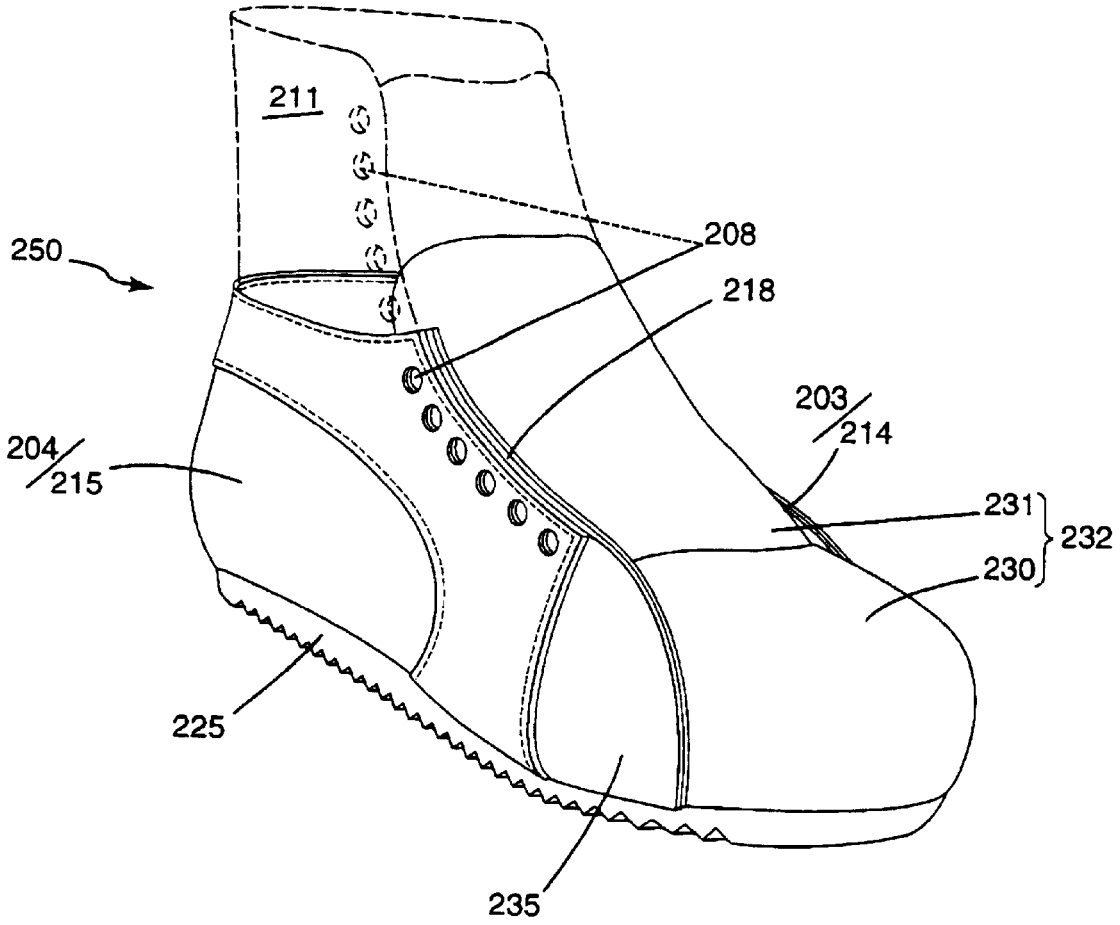
FIG. 16 is a perspective view of a third embodiment of a molded inner shell component of a footwear constructed according to the invention.

As shown in FIGS. 15 and 16, lace eyelets 208 are punched into the assembly of skin 200 and inner shell 220 along each edge 218. A toe box 230 and a tongue 231 or preferably, a toe-box/tongue assembly 232, which covers the frontal portion of the footwear 250 are installed. Toe-box, tongue assembly 232 is of course, manufactured separately and brought to the production line at the end of the production cycle only. Tongue 231 is sewn or glued to toe-box 230. Toe-box 230 is glued to the upper frontal portion of sole 220 and can also be glued or sewn to the frontal portions 235 of each quarter 203/214 and 204/215. Finally, a pair of outsoles 222 and 223, which are ground engaging supporting elements, are affixed to the bottom of footwear 250. As shown in FIG. 16, a single outsole 225 extending the entire length of footwear 250 can be used as well.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A method of making footwear comprising the steps of:

(a) positioning a skin assembly over a structural molded inner shell component, said structural molded inner shell component having a sole portion, a lateral quarter, and a medial quarter, each quarter projecting upwardly from each side of said sole portion;

(b) adhesively affixing said skin assembly to said structural molded inner shell component by applying pressure on the entire surface of said skin assembly;

(c) perforating lace eyelets through said structural molded inner shell and said skin assembly; and (d) mounting a toe box and a tongue to the front portion of said structural molded inner shell component.

2. The method of making footwear as defined in claim 1 further comprising the step of mounting a ground-engaging supporting element to the sole portion of said structural molded inner shell component.

3. The method of making footwear as defined in claim 2 further comprising the step of inserting a footbed into said footwear for cushioning the bottom portion of said footwear.

4. The method of making footwear as defined in claim 1 wherein said perforating of lace eyelets is done with a punch.

5. The method of making footwear as defined in claim 1 wherein said skin assembly is cut from a flat piece of material and folded to conform to the general shape of said structural molded inner shell component.

6. A method of making an ice skate comprising the steps of:

(a) positioning a skin assembly over a structural molded inner shell component, said structural molded inner shell component having a sole portion, a lateral quarter, and a medial quarter, each quarter projecting upwardly from each side of said sole portion;

(b) adhesively affixing said skin assembly to said structural molded inner shell component by applying pressure on the entire surface of said skin assembly;

(c) perforating lace eyelets through said structural molded inner shell and said skin assembly; and (d) mounting a toe box and a tongue to the front portion of said structural molded inner shell component.

7. The method of making an ice skate as defined in claim 6 further comprising the step of mounting an ice runner and runner holder assembly to the sole portion of said structural molded inner shell component.

8. The method of making an ice skate as defined in claim 7 further comprising the step of inserting a footbed into said ice skate for cushioning the bottom portion of said ice skate.

9. The method of making an ice skate as defined in claim 6 wherein said perforating of lace eyelets is done with a punch.

10. The method of making an ice skate as defined in claim 6 wherein said skin assembly is cut from a flat piece of material and folded to conform to the general shape of said structural molded inner shell component.

11. A method of making an in-line roller skate comprising the steps of:

(a) positioning a skin assembly over a structural molded inner shell component, said structural molded inner shell component having a sole portion, a lateral quarter, and a medial quarter, each quarter projecting upwardly from each side of said sole portion;

(b) adhesively affixing said skin assembly to said structural molded inner shell component by applying pressure on the entire surface of said skin assembly;

(c) perforating lace eyelets through said structural molded inner shell and said skin assembly; and (d) mounting a toe box and a tongue to the front portion of said structural molded inner shell component.

12. The method of making an in-line roller skate as defined in claim 11 further comprising the step of mounting an in-line roller chassis to the sole portion of said structural molded inner shell component.

13. The method of making an in-line roller skate as defined in claim 12 further comprising the step of inserting a footbed into said skate for cushioning the bottom portion of said skate.

14. The method of making an in-line roller skate as defined in claim 11 wherein said perforating of lace eyelets is done with a punch.

15. The method of making an in-line roller skate as defined in claim 11 wherein said skin assembly is cut from a flat piece of material and folded to conform to the general shape of said structural molded inner shell component.

* * * * *